US010677005B2

(12) United States Patent
van Hove et al.

(10) Patent No.: US 10,677,005 B2
(45) Date of Patent: Jun. 9, 2020

(54) REVERSE CIRCULATION DEBRIS REMOVAL TOOL WITH WELL CONTROL FEATURE

(71) Applicant: Baker Hughes, a GE company, LLC, Houston, TX (US)

(72) Inventors: Joeri van Hove, Cypress, TX (US); Ammar A. Munshi, Sugar Land, TX (US); André J. Porter, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 184 days.

(21) Appl. No.: 15/818,285

(22) Filed: Nov. 20, 2017

(65) Prior Publication Data

US 2019/0153796 A1 May 23, 2019

(51) Int. Cl.

| | |
|---|---|
| ***E21B 27/00*** | (2006.01) |
| ***E21B 34/06*** | (2006.01) |
| ***E21B 34/08*** | (2006.01) |
| ***E21B 34/16*** | (2006.01) |
| *E21B 49/08* | (2006.01) |
| *E21B 47/06* | (2012.01) |
| *E21B 47/10* | (2012.01) |
| *E21B 34/00* | (2006.01) |

(52) U.S. Cl.

CPC ..... *E21B 27/00* (2013.01); *E21B 34/066* (2013.01); *E21B 34/08* (2013.01); *E21B 34/16* (2013.01); *E21B 47/06* (2013.01); *E21B 47/065* (2013.01); *E21B 47/10* (2013.01); *E21B 49/08* (2013.01); *E21B 2034/005* (2013.01)

(58) Field of Classification Search

CPC ..... E21B 27/00; E21B 27/005; E21B 27/02; E21B 27/04

See application file for complete search history.

(56) References Cited

U.S. PATENT DOCUMENTS 1,513,083 A * 10/1924 Baker ..... E21B 27/00 175/234
1,513,443 A * 10/1924 Boynton ..... E21B 27/00 166/167
1,958,915 A * 5/1934 Fletcher ..... E21B 27/00 166/109
2,050,289 A * 8/1936 Dunlap ..... E21B 27/00 166/165
2,061,489 A * 11/1936 Taylor ..... E21B 27/00 175/242

(Continued)

FOREIGN PATENT DOCUMENTS

DE 19859666 A1 * 3/2000 ..... E21B 27/00

*Primary Examiner* — Blake E Michener
(74) *Attorney, Agent, or Firm* — Shawn Hunter

(57) ABSTRACT

A reverse circulation debris cleanup tool has a pressure control valve that closes up a passage through the body based on a sensed well condition to help pressure control the well when rams close around the tool to isolate the surrounding annulus. The sensor can hold the valve open for a predetermined time to allow debris removal operations and then close. The debris chamber below an eductor in a VACS tool can be thousands of feet long and the valve can provide protection during running in or removal of the tool from well pressure events so as to avoid using shear rams and losing the bottom hole assembly in the borehole and a fishing operation to get it out.

21 Claims, 3 Drawing Sheets

(56) References Cited

U.S. PATENT DOCUMENTS 2,169,922 A * 8/1939 Notley ..... E21B 27/005 166/99
2,182,374 A * 12/1939 Dumble ..... E21B 4/10 166/104
2,550,080 A * 4/1951 Moore ..... E21B 27/00 166/151
2,700,567 A * 1/1955 Fortenberry ..... E21B 27/00 166/66.5
3,023,810 A * 3/1962 Anderson ..... E21B 27/005 166/227
4,190,113 A * 2/1980 Harrison ..... E21B 27/00 166/107
4,493,383 A * 1/1985 Williams ..... E21B 27/00 166/105.1
4,721,156 A * 1/1988 Campbell ..... E21B 27/00 166/105.3
4,924,940 A * 5/1990 Burroughs ..... E21B 27/00 166/105.1
6,158,512 A * 12/2000 Unsgaard ..... E21B 37/08 166/105.1
6,196,319 B1 * 3/2001 Henskens ..... E21B 37/00 166/163
6,276,452 B1 * 8/2001 Davis ..... E21B 21/002 166/298
6,427,776 B1 * 8/2002 Hoffman ..... E21B 23/04 166/311
7,472,745 B2 1/2009 Lynde et al.
7,610,957 B2 * 11/2009 Davis ..... E21B 29/002 166/99
7,836,955 B2 * 11/2010 Creighton ..... E21B 43/128 166/107
8,453,724 B2 * 6/2013 Zhou ..... E21B 27/00 166/99
9,494,005 B2 11/2016 Stowe
2002/0174987 A1 * 11/2002 Hoffman ..... E21B 23/04 166/312
2008/0236834 A1 * 10/2008 Creighton ..... E21B 27/00 166/311
2009/0151936 A1 6/2009 Greenaway
2010/0288492 A1 * 11/2010 Blackman ..... E21B 27/005 166/250.01
2011/0024119 A1 * 2/2011 Wolf ..... E21B 34/06 166/301
2012/0061073 A1 * 3/2012 Soni ..... E21B 27/04 166/99
2012/0118571 A1 * 5/2012 Zhou ..... E21B 27/00 166/301
2012/0152522 A1 * 6/2012 Lynde ..... E21B 37/10 166/99

* cited by examiner

REVERSE CIRCULATION DEBRIS REMOVAL TOOL WITH WELL CONTROL FEATURE

FIELD OF THE INVENTION

The field of the invention is wellbore cleaning devices and more particularly devices that collect debris with reverse circulation and employ a closure for well control when the device is run in or pulled out of the hole.

BACKGROUND OF THE INVENTION

Wellbore cleanup tools such as those offered by Baker Hughes Incorporated, a GE company under the name VACS have been in use to remove and capture borehole debris. These tools work on an eductor powered by tubing flow from the surface to draw debris laden flow into the bottom of the tool. The flow enters through an inlet tube surrounded by a debris reservoir. The heavier debris settles into the reservoir while smaller debris continues up the tool drawn by the eductor fluid inlet at which there is a reduced pressure due to the connected motive fluid. The drawn fluid is moved through a screen inside the tool to further remove particulates. The eductor discharge is laterally to the surrounding annulus where the flow can go in two opposed directions. Most of the flow goes to the surface through the annulus and the rest goes down the annulus and is drawn into the open lower end of the tool with fresh debris laden flow. Some examples of this tool are shown in U.S. Pat. No. 7,472,745 and more recently as improved in U.S. Pat. No. 9,494,005. Flapper valves to retain debris from falling out of a tool once brought into the tool and using sensors to detect well conditions in bottom hole assemblies in a jet cleaning application are shown in US 2009/0151936.

What the reverse circulation debris cleanup devices have not had in the past is a way to control the well as the devices are run in or being removed. The collected debris reservoirs have also increased in length to over 1000 meters below eductor 34. The problem this causes is that the tool will have wall openings that cannot be captured in a lubricator because of limited length of lubricators of about 30 meters. This make a need for isolating the formation for running in or removal of the debris cleanup tool. The situation is schematically illustrated in FIG. 1. The debris removal tool 10 has a debris inlet 12 at the lower end. The lower end 12 is open to flow during normal operation. Arrows 14 schematically illustrate a pressure surge from the formation below which needs to be controlled. Presently such a pressure surge can communicate to the surface despite the fact that rams 16 on a blowout preventer close off the annulus 18 with arrows 20 schematically representing the closure in the annulus 18. The flow represented by arrows 14 continues unhindered to the surface despite the annulus 18 being secured with rams 16.

The present invention addresses this shortcoming in the prior designs by providing a closure against pressure surges from the formation before they even begin. The device adds a valve that stays open for normal operation as shown in FIG. 2 and that can be triggered to close with a sensor that detects a predetermined condition to shut the isolation valve within the tool housing to control the well with the assistance of the closure of the rams to secure the surrounding annulus. These and other aspects of the present invention will be more readily apparent to those skilled in the art from a review of the description of the preferred embodiment and the associated drawings with the understanding that the full scope of the invention is to be determined by the literal and equivalent scope of the appended claims.

SUMMARY OF THE INVENTION

A reverse circulation debris cleanup tool has a pressure control valve that closes up a passage through the body based on a sensed well condition to help pressure control the well when rams close around the tool to isolate the surrounding annulus. The sensor can hold the valve open for a predetermined time to allow debris removal operations and then close. The debris chamber below an eductor in a VACS tool can be thousands of feet long and the valve can provide protection during running in or removal of the tool from well pressure events so as to avoid using shear rams and losing the bottom hole assembly in the borehole and a fishing operation to get it out.

DETAILED DESCRIPTION OF THE PREFERRED EMBODIMENT

Figure 1:
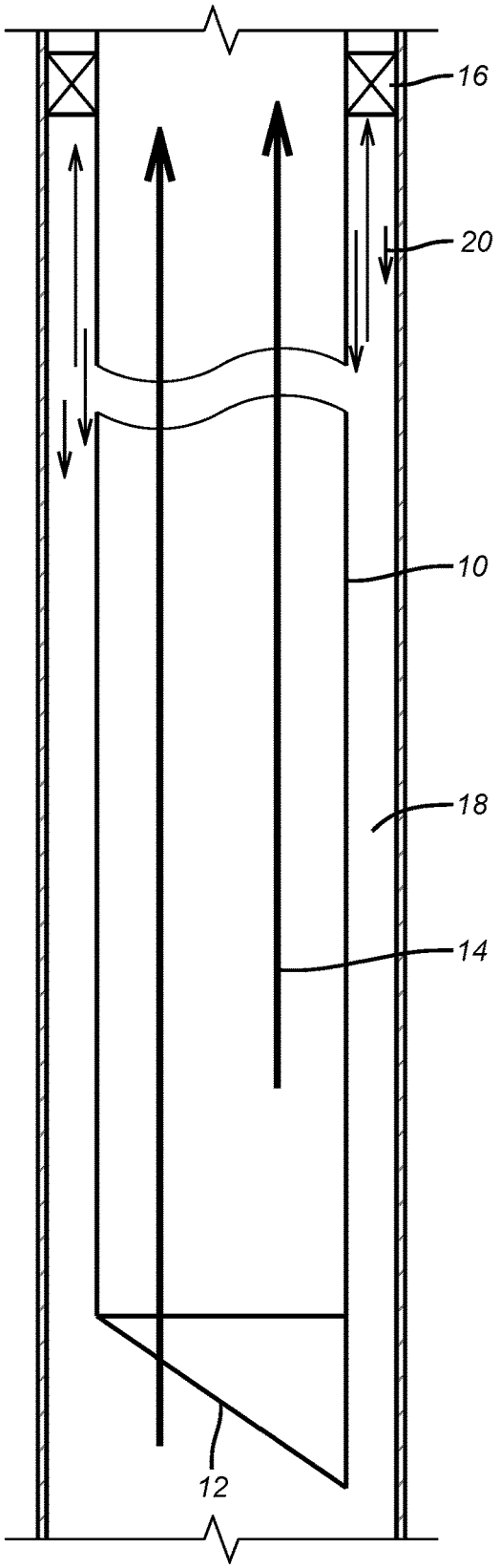
(PRIOR ART) FIG. 1
FIG. 1 is a prior art schematic view of a reverse circulation debris removal tool without a pressure control valve in a passage therethrough.
Figure 2:
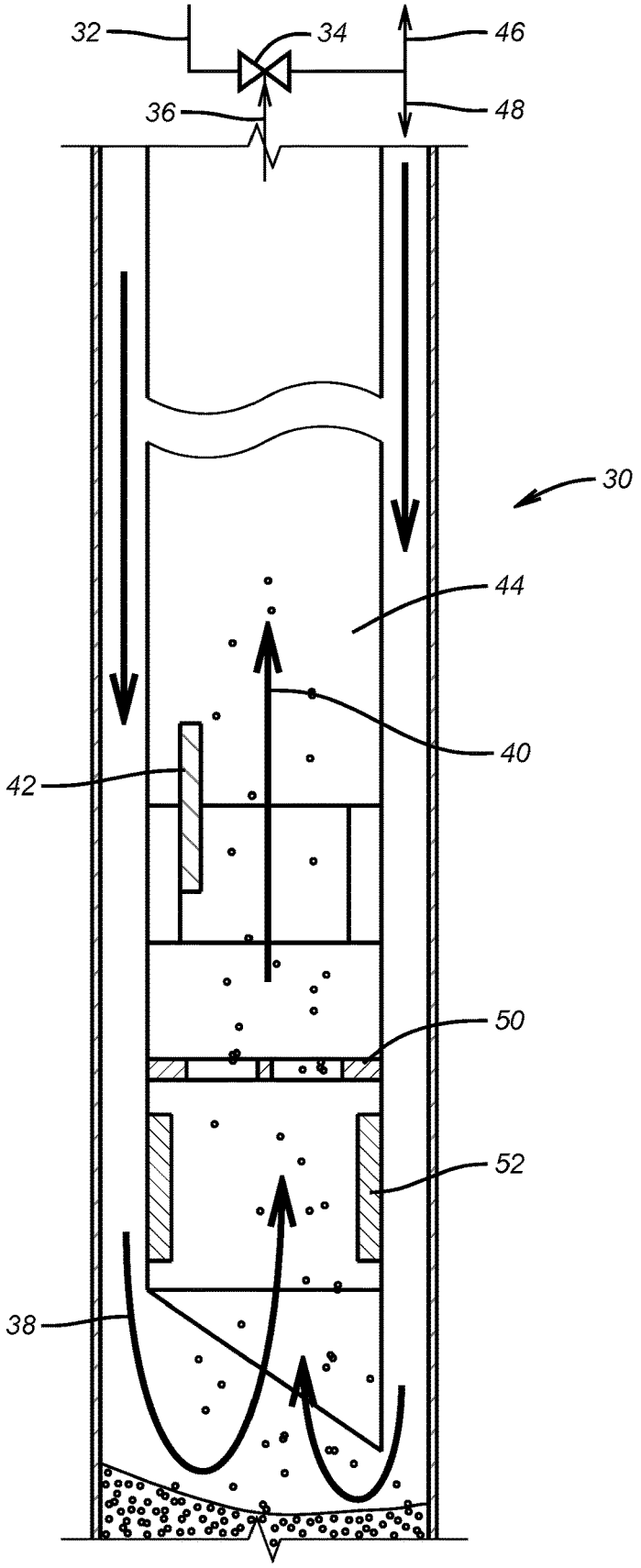
FIG. 2 is a view of a normal operation of a reverse circulation debris removal tool with the through passage valve in the open position.

FIG. 2 shows a reverse circulation debris removal tool 30 schematically. Line 32 comes from a surface location to provide the motive force for eductor 34 to reduce pressure in line 36 so that debris laden fluid represented schematically by arrows 38 can be drawn into the housing. The discharge line from the eductor 34 is connected to the housing and results in flow in the surrounding annulus indicated by arrows 46 and 48. With line 32 closed at a surface or subsea location and valve 50 also closed, pressure from the formation is isolated from the surface when running in or pulling out of the hole. Arrow 40 indicates the debris laden flow going uphole past a flapper or other closure 42 designed to retain the debris in the housing passage 44 if circulation stops. In between arrow 40 and inlet 36 there is a screen to remove fine particles to minimize erosion in the eductor 34. The outlet flow from the eductor 34 goes uphole as represented by arrow 46 and downhole as represented by arrow 48. Valve 42 is designed to hold in captured debris but a pressure surge from the formation will open valve 42 making it ineffective in well control situations.

Valve 50 is provided in passage 44 below the eductor 34 and is controlled in a variety of ways to close at an appropriate time to contain formation pressure safely. A sensor 52 is schematically illustrated in the tool 30 but can easily be part of a communication system from the surface that will trigger the valve 52 to close to contain well pressure.

Figure 3:
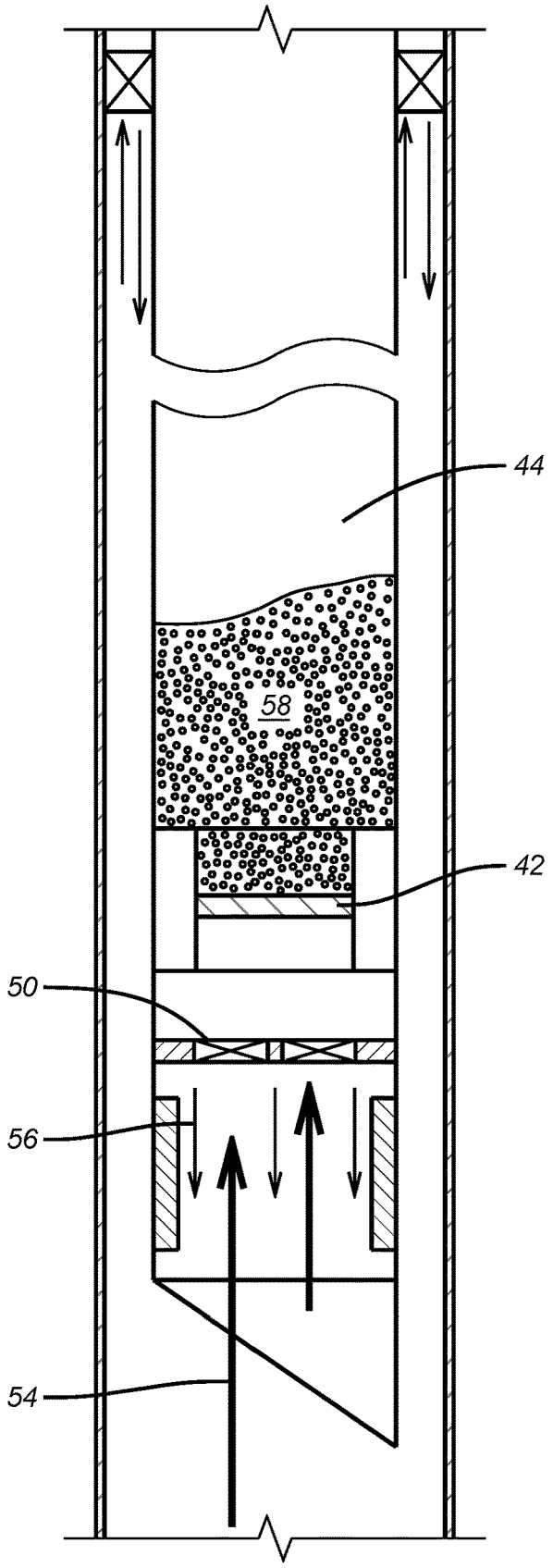
FIG. 3 is the view of FIG. 2 with the through passage valve in the closed position.

FIG. 3 illustrates valve 50 in the closed position. Arrows 54 and 56 schematically illustrate the contained formation pressure in passage 44. Trapped debris 58 sits on closed flapper 42 that has closed due to lack of flow from the closure of valve 50.

The system to trigger the valve 50 to close can include flow or lack of flow, flow rate change, temperature, vibration, magnetic force, rotation, acoustic, electric, applied pressure, pressure cycles, pressure drop or loss, hydrostatic pressure, presence of specific fluids or of fluids having specific physical properties, or a combination of any of the above. Other triggers to selectively close valve 50 pressure drop or vibration induced flow, time delays after the onset of flow to allow the debris cleanup to conclude, dropping objects or fluids into the string or magnets or other types of sonde to trigger the closure of the valve. The signal can be acoustic through the tubular wall or electric within or on either side of a tubular wall. A circulation sub above the debris removal tool can be used to allow circulation after the valve 50 is closed, if desired. Pressure can be delivered from the surface with the valve closed to make sure valve 50 is closed and holding pressure.

The use of the valve 50 allows tripping in or out with the valve closed for well control purposes. Standard barriers would impede the flow needed during debris capture operations. The implemented solution to provide pressure control protection has to be implemented after the suction created by the eductor has finished sucking in debris and the tool is ready to come out. The valve 50 can be designed to run in closed for protection going in the hole and then triggered to open for at least a predetermined time or until triggered to close either from local conditions or from a surface signal. The fact of the barrier valve 50 closing, if locally initiated, can be signaled to the surface. Alternatively the signal to close can come from the surface. The idea is to control well pressure excursions when running in or pulling out the tool assembly that could be longer than 100 meters for storage capacity.

The above description is illustrative of the preferred embodiment and many modifications may be made by those skilled in the art without departing from the invention whose scope is to be determined from the literal and equivalent scope of the claims below:

We claim:

1. A well control assembly for a debris removal tool that operates on a reverse circulation regime, comprising:

a housing having an inlet adjacent a lower end thereof;

an eductor to draw debris laden fluid into said lower end, said eductor actuated by flow of fluid into the eductor from a surface location to draw debris laden fluid upwardly, said eductor discharging fluid through a wall port in said housing to a surrounding annulus;

a debris storage volume in said housing above said lower end;

a barrier valve selectively operated to close a passage through said housing for pressure control of a formation below said housing, said barrier valve being effective to constrain increased formation pressure below the barrier valve when closed.

2. The assembly of claim 1, wherein:

said barrier valve is located in said housing between said wall port and said lower end of said housing.

3. The assembly of claim 1, wherein:

said barrier valve blocks formation pressure from passing through said passage.

4. The assembly of claim 1, wherein:

said barrier valve is located below the debris storage volume.

5. The assembly of claim 4, wherein:

said debris storage volume further comprises a flapper valve that falls shut on loss of flow through said debris storage volume.

6. The assembly of claim 1, wherein:

said barrier valve is run in closed and is remotely operated to open to allow operation of said eductor to capture debris in said housing.

7. The assembly of claim 1, wherein:

a sensor is located within the housing; and said barrier valve is triggered to close against increased formation pressure based on at least one well condition which is sensed by the sensor.

8. The assembly of claim 1, wherein:

said barrier valve can be triggered to close based on a signal delivered from a remote location to said barrier valve.

9. The assembly of claim 1, wherein:

said barrier valve can transmit a signal to a remote location when triggered to close.

10. The assembly of claim 1, wherein:

sensed signals that can close said barrier valve comprises at least one of flow or absence of flow, housing movement, application of a field, passage of time, pressure variation, acoustic, electric, temperature change, physical property change in surrounding well fluid, flow variation and predetermined ambient pressure.

11. A well control method using a debris removal tool that operates on a reverse circulation regime, comprising:

providing a housing having an inlet adjacent a lower end of the debris removal tool;

operating an eductor to draw debris laden fluid into said lower end, said eductor actuated by flow of fluid into the eductor from a surface location to draw debris laden fluid upwardly, said eductor discharging fluid through a wall port in said housing to a surrounding annulus;

locating a debris storage volume in said housing above said lower end;

locating a barrier valve selectively operated to close a passage through said housing for pressure control of a formation below said housing, said barrier valve being effective to constrain increased formation pressure below the barrier valve when closed.

12. The method of claim 11, wherein:

said barrier valve is located in said housing between said wall port and said lower end of said housing.

13. The method of claim 11, further comprising:

blocking formation pressure from passing through said passage with said barrier valve when running in or when pulling out of a hole.

14. The method of claim 11, wherein:

said barrier valve is located below said debris storage volume.

15. The method of claim 14, further comprising:

providing a flapper valve that falls shut on loss of flow through said storage location, said flapper valve located adjacent said debris storage volume.

16. The method of claim 11, further comprising:

running in said barrier valve closed and remotely operating said barrier valve to open to allow operation of said eductor to capture debris in said housing.

17. The method of claim 11, wherein:

said barrier valve is triggered to close against increased formation pressure based on at least one well condition which is sensed by a sensor within the housing.

18. The method of claim 11, wherein:

said barrier valve is triggered to close based on a signal delivered from a remote location to said barrier valve.

19. The method of claim 11, further comprising:

transmitting a signal from said barrier valve to a remote location when said barrier valve is triggered to close.

20. The method of claim 11, further comprising:

operating said barrier valve to close with a sensed signal that comprises at least one of flow or absence of flow, housing movement, application of a field, passage of time, pressure variation, acoustic, electric, temperature change, physical property change in surrounding well fluid, flow variation and predetermined ambient pressure.

21. A well control method using a debris removal tool that operates on a reverse circulation regime, comprising:

drawing debris laden fluid into the lower end of a housing of the debris removal tool having an inlet adjacent thereto using an eductor actuated by flow of fluid into the eductor from a surface location to draw debris laden fluid upwardly;

separating a portion of debris from the debris laden fluid;

storing the portion of debris separated from the debris laden fluid in a portion of the housing above the lower end;

retaining debris laden fluid previously drawn into the lower end of said housing and preventing additional fluid or pressure from the surrounding wellbore through said housing with a selectively closed barrier valve located between said lower end and said eductor in said housing, said barrier valve being effective to constrain increased formation pressure below the barrier valve when closed.

* * * * *